US008051847B2

(12) United States Patent
Hu

(10) Patent No.: US 8,051,847 B2
(45) Date of Patent: Nov. 8, 2011

(54) GAS INTAKE CONTROL MECHANISM FOR TOY GUN

(76) Inventor: Shih-Che Hu, Yung Kang (TW)

( * ) Notice: Subject to any disclaimer, the term of this patent is extended or adjusted under 35 U.S.C. 154(b) by 174 days.

(21) Appl. No.: 12/645,343

(22) Filed: Dec. 22, 2009

(65) Prior Publication Data

US 2011/0146647 A1 Jun. 23, 2011

(51) Int. Cl.
*F41B 11/32* (2006.01)

(52) U.S. Cl. ..... 124/73; 42/54

(58) Field of Classification Search ..... 42/54; 124/73, 124/75, 76

See application file for complete search history.

(56) References Cited

U.S. PATENT DOCUMENTS 6,112,734 A * 9/2000 Kunimoto ..... 124/73
2007/0144507 A1* 6/2007 Hu ..... 124/70

* cited by examiner

*Primary Examiner* — Stephen M Johnson
(74) *Attorney, Agent, or Firm* — Pro-Techtor Int'l Services

(57) ABSTRACT

A toy gun gas intake control mechanism includes a holder frame, an impact member having an elongated pivoted with its bottom end to the holder frame, a striking block, a pivot axle that pivotally connects the striking block to the top end of the elongated base and a spring member for revering the striking block, a retaining block supported on a spring member in the holder frame and having a retaining notch for retaining the outer end of the pivot axle. When firing a bullet, the bolt body of the toy gun moves forwards, the striking block strikes a seal member to open a gas inlet, and the pivot axle is moved out of the retaining notch of the retaining block for allowing upward displacement of the retaining block. When the bolt body moves backward after firing, the retaining block is forced downwards to the inside or the holder frame by the bolt body, the outer end of the pivot axle is engaged into the retaining notch, and the striking block is returned, causing the seal member to close the gas inlet again.

5 Claims, 9 Drawing Sheets

GAS INTAKE CONTROL MECHANISM FOR TOY GUN

BACKGROUND OF THE INVENTION

1. Field of the Invention

The present invention relates to toy guns and more particularly, to a gas intake control mechanism for toy gun, which utilizes the linking arrangement of a retaining block, a holder frame and an impact member to control the intake of compressed gas.

2. Description of the Related Art

The gas-driven firing unit a of a regular air-soft gun, as shown in FIG. 1, generally comprises a bolt body 10, a piston 20, a hammer 30, a gas intake control mechanism 40 and a magazine 50. The bolt body 10 has an accommodation chamber 101 at the front side for accommodating the piston 20, and an opening 102 at the rear side within which the hammer 30 is operable. The gas intake control mechanism 40 is arranged in front of the hammer 30 and behind the magazine 50. The magazine 50 is disposed beneath the piston 20, having accommodated therein a seal member 501. The seal member 501 can be moved forwards to open the gas inlet 201 or the piston 20 for allowing compressed gas to flow out of the magazine 50 into the inside of the piston 20 to force the holt body 10 backwards, thereby producing a backlash. After production of a backlash, the seal member 501 is moved backwards to close the gas inlet 201, thereby stopping the supply of compressed gas. At this time, the bolt body 10 is moved forwards to its former position.

According to the aforesaid structure, the seal member 501 is movable forwards/backwards to open/close the gas inlet 201. As shown in FIGS. 1~3, the gas intake control mechanism 40 comprises a holder frame 401, an impact member 402 and a stop block 403 (the stop block 403 is not shown in FIGS. 1 and 3). The impact member 402 is pivotally connected to the holder frame 401, and biasable in and out of the holder frame 401. The stop block 403 is pivotally connected to the top side of the holder frame 401 (see FIG. 2).

Further, the magazine 50 has a spring-supported retaining block 502 disposed at one lateral side relative to the seal member 501. When the spring-supported retaining block 502 is forced downwards, the seal member 501 can be moved backwards (see FIG. 3). When the toy gun is operated to fire a bullet, the impact member 402 is driven by the hammer 30 to force the seal member 501 forwards in opening the gas inlet 201 of the piston 20 (see FIG. 1). Thereafter, the bolt body 10 is moved backwards to produce a backlash (see FIG. 3). When the bolt body 10 is moved backwards to a predetermined distance, a bottom flange 103 of the bolt body 10 forces the spring-supported retaining block 502 downwards for allowing the seal member 501 to be returned to close the gas inlet 201 of the piston 20, and therefore the supply of compressed gas is stopped.

According to the aforesaid prior art design of gas intake control mechanism 40, the spring-supported retaining block 502 which controls forward/backward movement of the seal member 501 is mounted in the magazine 50. This arrangement complicates the structural design of the magazine 50 and its fabrication. Further, because the spring-supported retaining block 502 is located on a place in front of the holder frame 401 and the impact member 402, the supply of gas is quickly stopped, shortening the backward displacement distance of the bolt body 10, and therefore the backlash thus produced is reduced.

SUMMARY OF THE INVENTION

The present invention has been accomplished under the circumstances in view. It is the main object of the present invention to provide a gas intake control mechanism for toy gun, which eliminates the drawbacks of the aforesaid prior art design. It is another object of the present invention to provide a gas intake control mechanism for toy gun, which has a simple structure. It is still another object of the present invention to provide a gas intake control mechanism for toy gun, which utilizes the linking arrangement of a retaining block, a holder frame and an impact member to achieve control of forward and backward movement of a seal member, enhancing the backlash of the by gun.

To achieve these and other objects of the present invention, a gas intake control mechanism is installed in a toy gun in front of a hammer and behind a magazine. The toy gun gas intake control mechanism comprises a holder frame, an impact member, first spring member, a stop block, a retaining block and a second spring member. The holder frame has an opening located on a middle part thereof and an upwardly extending accommodation chamber, an impact member pivotally connected to the holder frame movable forwardly out of the opening by the hammer to strike a seal member in the magazine for causing the seal member to open a gas inlet in a piston inside the toy gun. The impact member comprises an elongated base, a striking block and a pivot axle. The elongated base has a bottom end pivotally connected to the holder and a bumper portion backwardly extended from the top end thereof and strikable by the hammer. The striking block is pivotally connected to the front side of the top end of the elongated base and adapted for striking the seal member. The pivot axle pivotally connects the striking block to the elongated base, having an outer end. The first spring member is mounted around the pivot axle and connected between the holder frame and the elongated base of the impact member and adapted to impart a biasing force to the elongated base to hold the impact member in the opening of the holder frame. The stop block is pivotally connected to the top side of the holder frame and biasable upwards to stop the toy gun from firing a toy bullet. The retaining block is received in the accommodation chamber of the holder frame and movable in and out of the accommodation chamber. Further, the retaining block has a retaining notch adapted for receiving the outer end of the pivot axle to hold the impart member in the opening of the holder frame. The second spring member is mounted in the accommodation chamber of the holder frame and adapted to impart an upward pressure to the retaining block for forcing the retaining block partially out of the accommodation chamber when the outer end of the pivot axle is moved out of the retaining notch upon impact between the hammer and the bumper portion of the elongated base of the impact member. Further, the retaining block has an oblong coupling hole pivotally connected to the holder frame by a pivot pin for allowing the retaining block to be moved up and down relative to the holder frame within a predetermined distance.

Further, the retaining block has a recess located on an outside wall thereof above and adjacent to the oblong coupling hole and adapted for stopping the outer end of the pivot axle when the pivot axle is moved out of the retaining notch.

Further, the holder frame has a transverse through hole transversely extending through the opening. Further, the elongated base of the impact member has a coupling hole transversely located near the bottom end thereof and pivotally connected to the transverse through hole of the holder frame by a pivot pin.

The gas intake control mechanism further comprises a third spring member mounted in the elongated base and connected between the elongated base and the striking block, and adapted for imparting a biasing force to the striking block relative to the elongated base.

DETAILED DESCRIPTION OF THE PREFERRED EMBODIMENT

Figure 1:
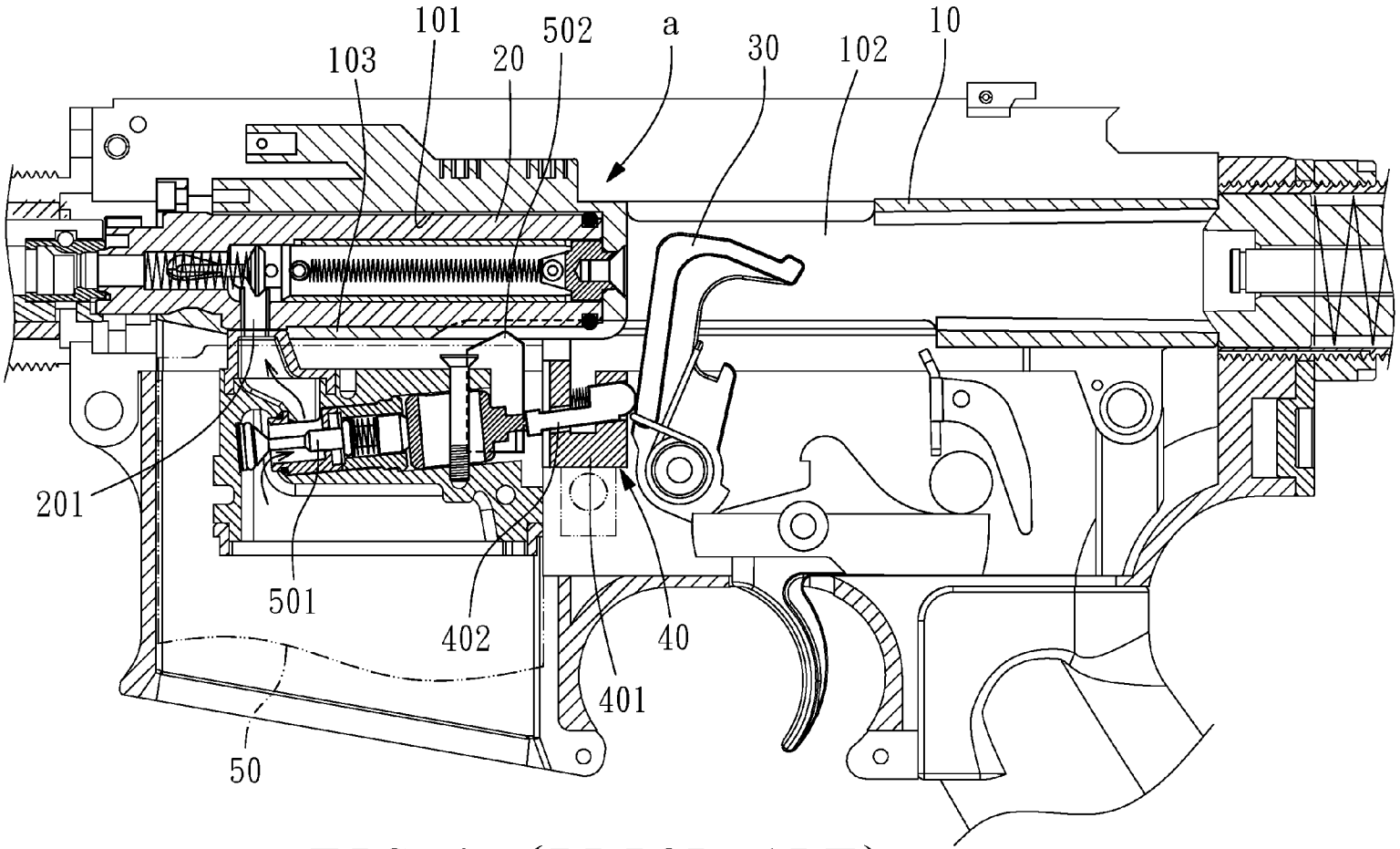
FIG. 1 (PRIOR ART)
FIG. 1 is a schematic drawing showing a gas intake status of a gas intake control mechanism of a toy gun according to the prior art.
Figure 2:
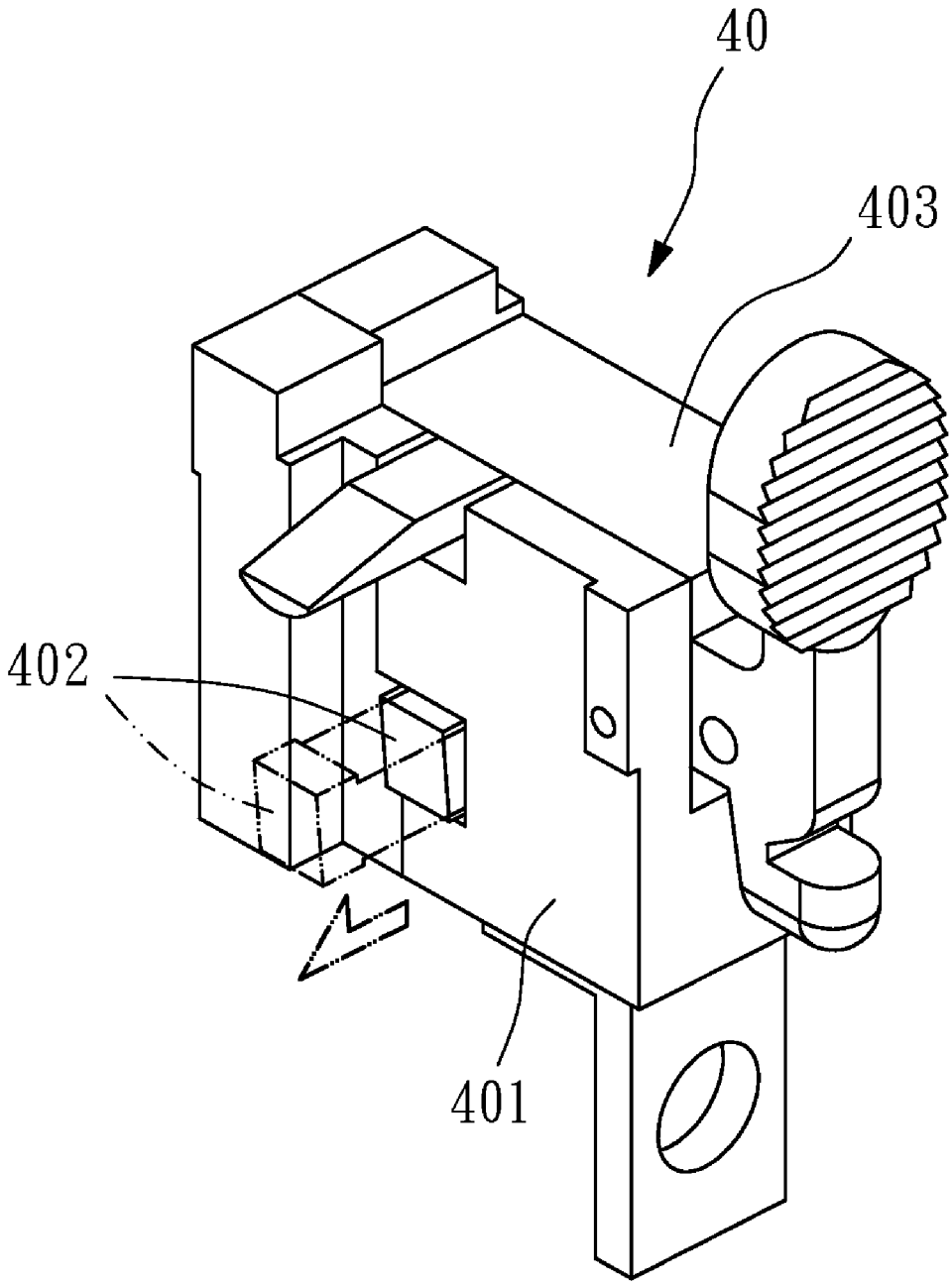
FIG. 2 (PRIOR ART)
FIG. 2 is a perspective view of the gas intake control mechanism according to the prior art.
Figure 3:
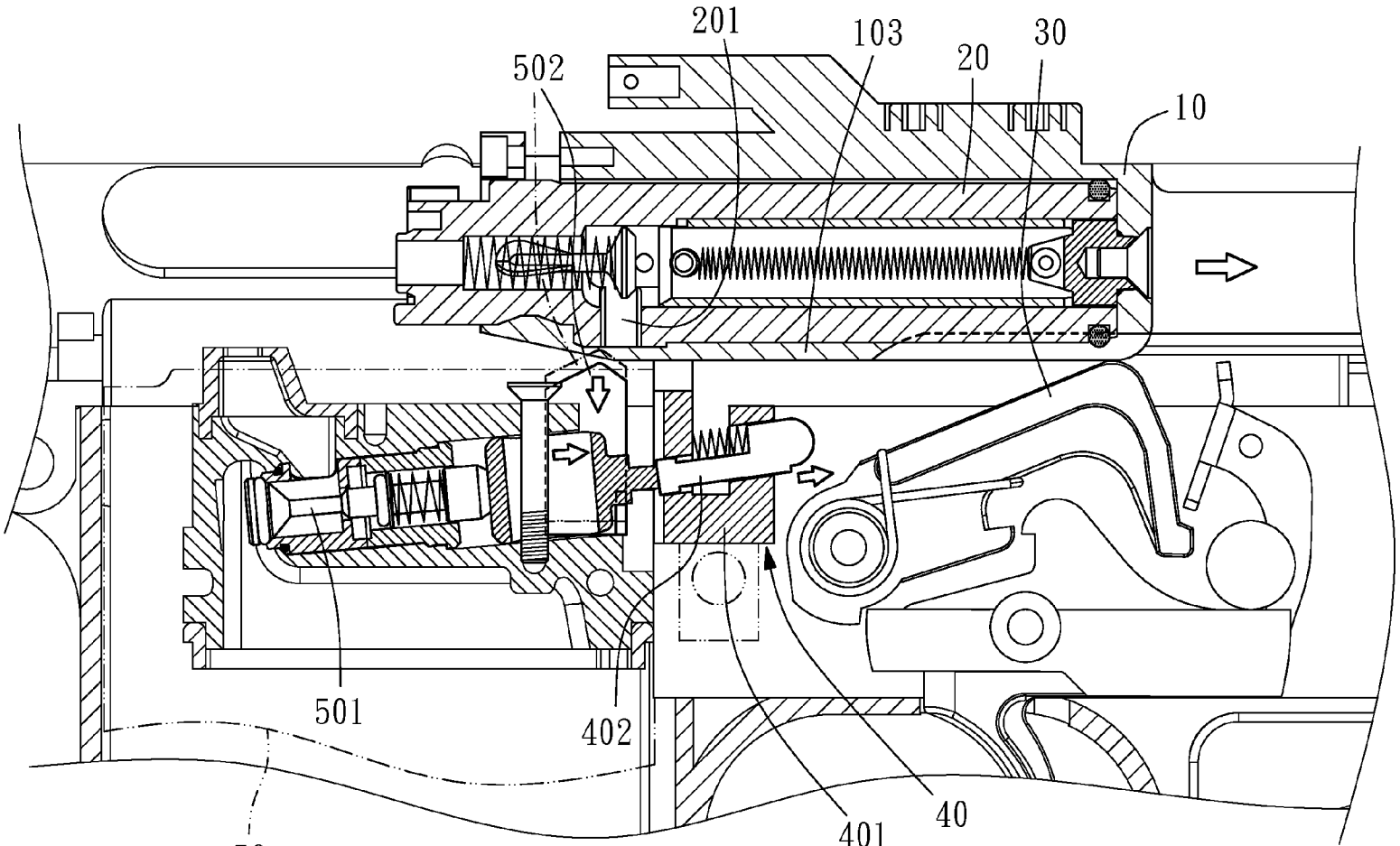
FIG. 3 (PRIOR ART)
FIG. 3 is a schematic drawing showing a gas-off status of the gas intake control mechanism in the toy gun according to the prior art.
Figure 4:
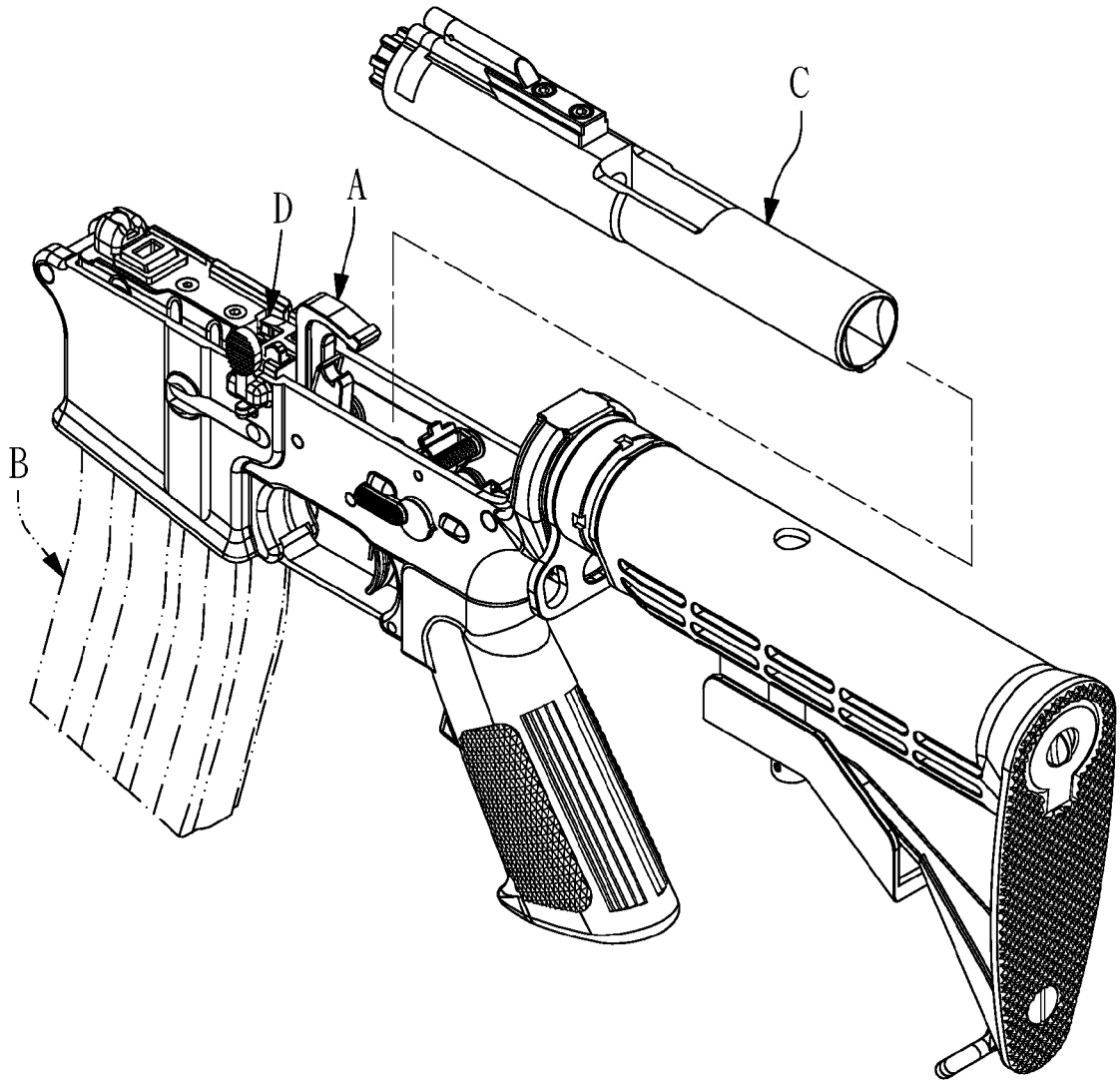
FIG. 4 is a schematic drawing sowing the positioning of a gas intake control mechanism in a toy gun according to the present invention.
Figure 5:
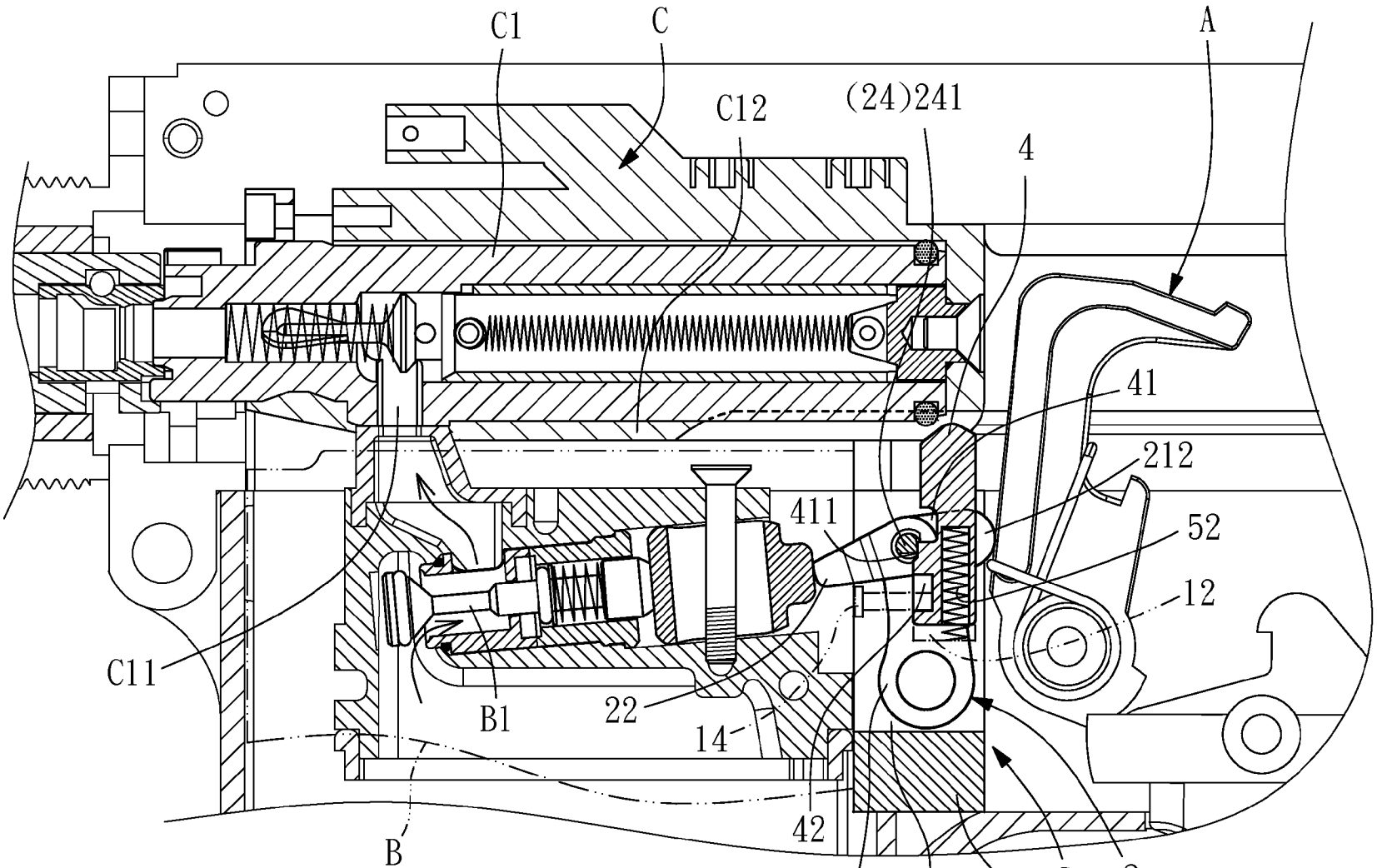
FIG. 5 is a schematic plain view of the present invention, showing a gas intake status of the gas intake control mechanism.
Figure 6:
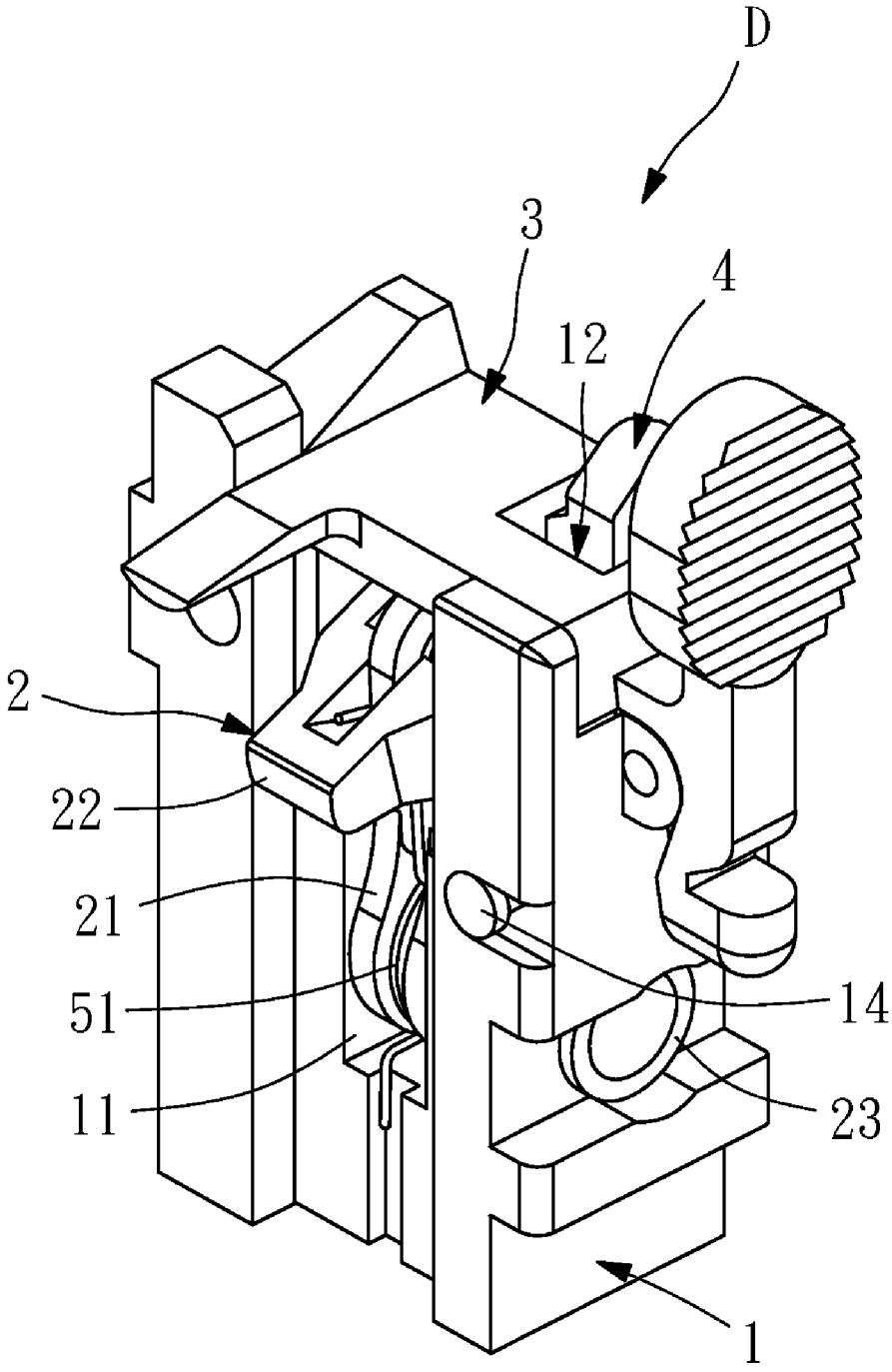
FIG. 6 is an elevational assembly view of the gas intake control mechanism according to the present invention.
Figure 7:
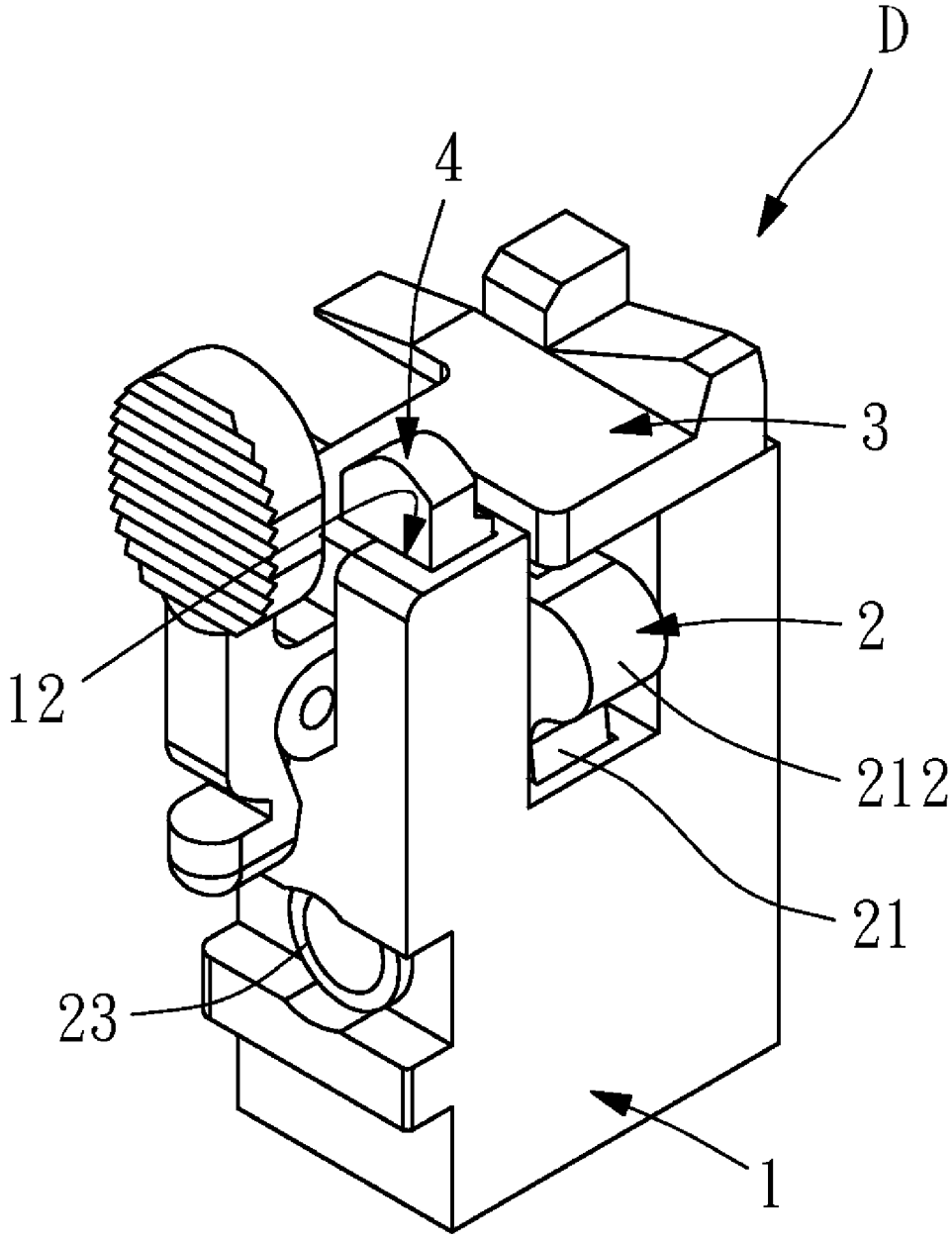
FIG. 7 corresponds to FIG. 6 when viewed from another angle.

Referring to FIGS. 4 and 5, a gas intake control mechanism D is shown installed in a toy gun in front of the hammer A behind the magazine B and beneath the bolt body C. The bolt body C accommodates a backwardly extending piston C1 (see FIG. 5). The magazine B has a seal member B1 movably disposed at the inner top side thereof. When the seal member B1 is moved forwards, the gas inlet C11 of the piston C1 is opened for enabling a how of compressed gas to go out of the magazine B into the inside of the piston C1 so that a backlash can be produced upon a backward displacement of the bolt body C (see FIG. 9). The gas intake control mechanism D comprises a holder frame 1, an impact member 2 and a stop block 3 (see FIGS. 6~8).

Figure 8:
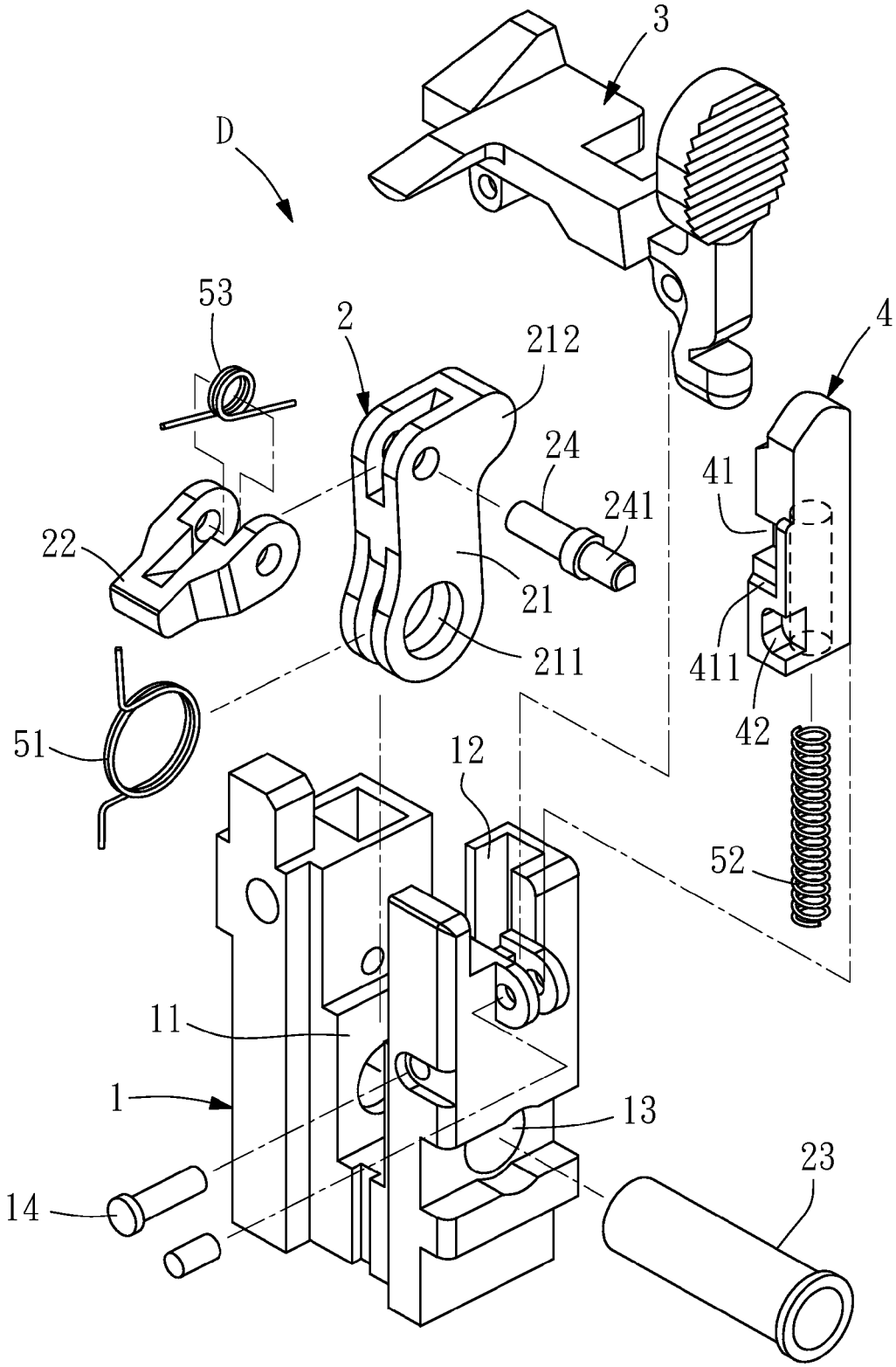
FIG. 8 is an exploded view of the gas intake control mechanism according to the present invention.
Figure 9:
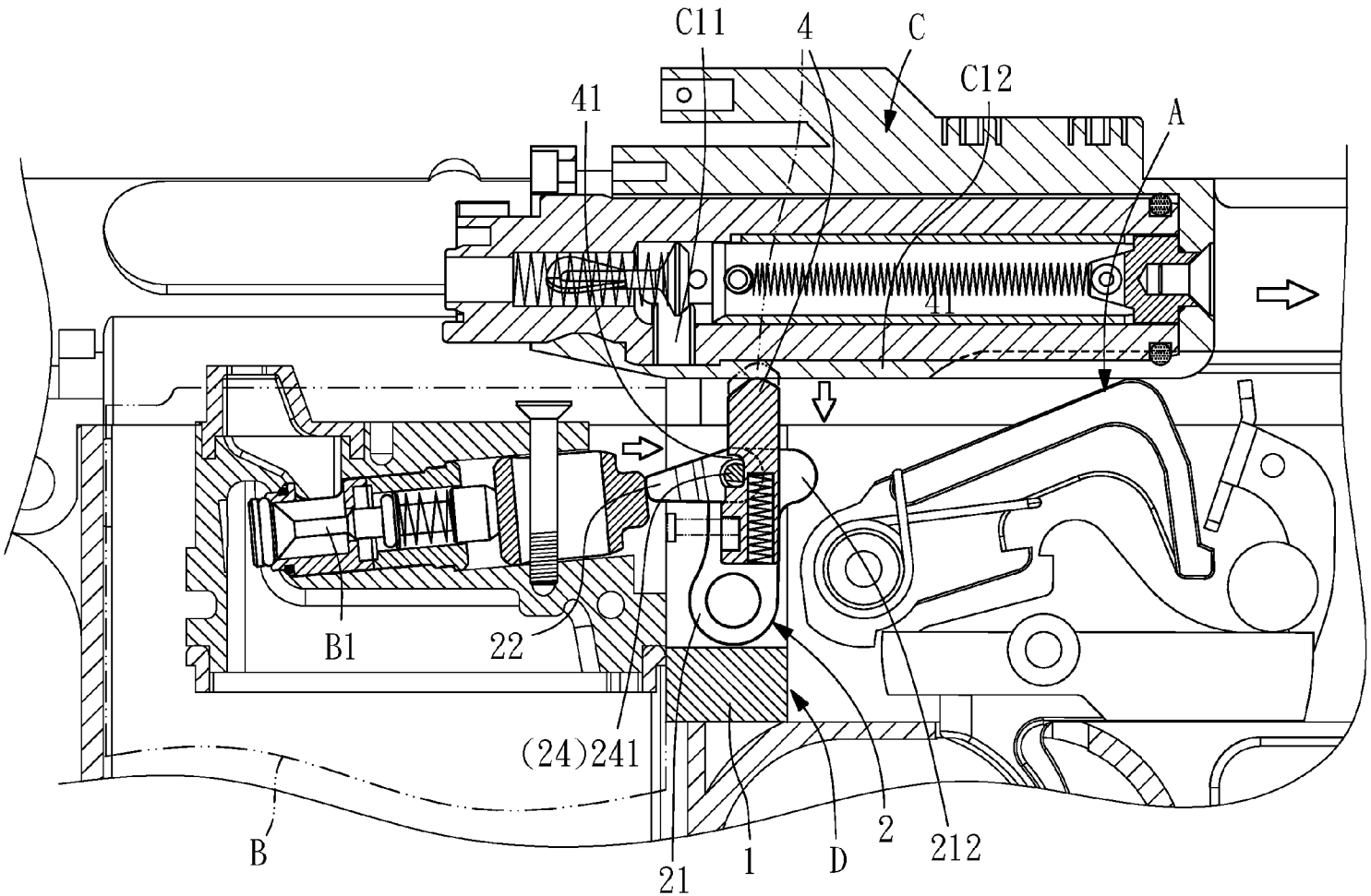
FIG. 9 is a schematic drawing of the present invention a gas-off status of the gas intake control mechanism.

The holder frame 1 has an opening 11, an upwardly extending accommodation chamber 12 and a transverse through hole 13 transversely cut through the opening 11 (see FIG. 8). The opening 11 is located on the middle of the holder frame 1. A retaining block 4 is downwardly inserted into the upwardly extending accommodation chamber 12 and supported on a second spring member, for example, compression spring 52 in the upwardly extending accommodation chamber 12. The compression spring 52 imparts an upward pressure to the retaining block 4. The retaining block 4 has a retaining notch 41, an oblong coupling hole 42 disposed near the bottom end thereof and a recess 411 located on the outside wall above and adjacent to the oblong coupling hole 42. A pivot pin 14 is inserted through the upwardly extending accommodation chamber 12 and the oblong coupling hole 42 of the retaining block 4 to couple the retaining block 4 to the holder frame 1, along the retaining block 4 to be moved up and down (in and out of the upwardly extending accommodation chamber 12) within a limited range (subject to the length of the major axis of the oblong coupling hole 42).

The impact member 2 is received in the opening 11 of the holder frame 1, comprising an elongated base 21 and a striking block 22 (see FIG. 8). The elongated base 21 has a coupling hole 211 transversely cut through the bottom end thereof and pivotally coupled to the transverse through hole 13 of the holder frame 1 by a pivot shaft 23. Further, a first spring member, for example, torsional spring 51 is mounted around the pivot shaft 23 and stopped with its two opposite ends thereof against the elongated base 21 of the impact member 2 and a part of the holder frame 1 below the opening 11 (see FIG. 6) for reversing the impact member 2 after the impact member 2 having been forced forwards. Further, the elongated base 21 has a bumper portion 212 backwardly extended from top end thereof. The striking block 22 is pivotally connected to the top end of the elongated base 21 in front of the stroke portion 212 by a pivot axle 24. The pivot axle 24 has an outer end 241. Further, a third spring, for example, torsional spring 53 is mounted around the pivot axle 24 and stopped with its two opposite ends against the striking block 22 and the elongated base 21.

The stop block 3 (see FIGS. 6~8) is pivotally mounted on the top side of the holder frame 1. When no bullet is to be fired, the stop block 3 is lifted.

When the toy gun is operated to fire a bullet, the hammer A is driven forwards (see FIG. 5) to strike the bumper portion 212 of the elongated base 21 or the impact member 2, forcing the striking block 22 forwards to strike the seal member B1 of the magazine B. Thus, the seal member B1 is moved forwards to open the gas inlet C11 of the piston C1 for enabling a flow or compressed gas to go out of the magazine B into the inside of the piston C1. Thereafter, the bolt body C is moved backwards to produce a backlash (see FIG. 9). During forward displacement of the impact member 2, the outer end 241 of the pivot axle 24 is moved out of the retaining notch 41 of the retaining block 4 (see FIG. 5). At this time, the retaining block 4 is pushed upwards by the second spring member 52. After the bolt body C has been moved backwards to a predetermined distance, the retaining block 4 is forced downwards by a bottom flange 12 of the bolt body C (see FIG. 9). At this time, the outer end 241 of the pivot axle 24 is engaged into the retaining notch 41 of the retaining block 4 again, and the impact member 2 is returned, and at the same time the seal member B1 is moved backwards to close the gas inlet C11 of the piston C1, thereby stopping the supply of compressed gas. Subject to the linking action of the retaining block 4, the holder frame and the impact member 2, the seal member B1 is moved forwards or backwards to control the supply of compressed gas.

As explained above, the linking arrangement of the retaining block 4, the holder frame 1 and the impact member 2 simplifies the design of the magazine B. Further, because the bolt body C is moved backwards to force the retaining block 4 downwards at a late time, the supply of compressed gas is stopped lately, enhancing the backlash and eliminating the drawback of the prior art design.

A prototype of toy gun gas intake control mechanism has been constructed with the features of FIGS. 4~9. The toy gun gas intake control mechanism functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A gas intake control mechanism installed in a toy gun in front of a hammer and behind a magazine, the toy gun gas intake control mechanism comprising:

a holder frame, said holder frame having an opening located on a middle part thereof and an upwardly extending accommodation chamber;

an impact member pivotally connected to said holder frame and movable forwardly out of said opening by said hammer to strike a seal member in said magazine for causing said seal member to open a gas inlet in a piston inside said toy gun, said impact member comprising an elongated base, a striking block and a pivot axle, said elongated base having a bottom end pivotally connected to said holder and a bumper portion backwardly extended from a top end thereof and strikable by said hammer, said striking block being pivotally connected to a front side of the top end of said elongated base and adapted for striking said seal member, said pivot axle pivotally connecting said striking block to said elongated base and having an outer end;

a first spring member mounted around said pivot axle and connected between said holder frame and said elongated base of said impact member and adapted to impart a biasing force to said elongated base to hold said impact member in said opening of said holder frame;

a stop block pivotally connected to a top side of said holder frame and biasable upwards to stop said toy gun from firing a toy bullet;

a retaining block received in said accommodation chamber of said holder frame and movable in and out of said accommodation chamber, said retaining block having a retaining notch adapted for receiving the outer end of said pivot axle to hold said impart member in said opening of said holder frame; and a second spring member mounted in said accommodation chamber of said holder frame and adapted to impart an upward pressure to said retaining block for forcing said retaining block partially out of said accommodation chamber when the outer end of said pivot axle is moved out of said retaining notch upon impact between said hammer and said bumper portion of said elongated base of said impact member.

2. The gas intake control mechanism as claimed in claim 1, wherein said retaining block further has an oblong coupling hole pivotally connected to said holder frame by a pivot pin for allowing said retaining block to be moved up and down relative to said holder frame within a predetermined distance.

3. The gas intake control mechanism as claimed in claim 2, wherein said retaining block has a recess located on an outside wall thereof above and adjacent to said oblong coupling hole and adapted for stopping the outer end of said pivot axle when said pivot axle is moved out of said retaining notch.

4. The gas intake control mechanism as claimed in claim 3, wherein said holder frame has a transverse through hole transversely extending through said opening; said elongated base of said impact member has a coupling hole transversely located near the bottom end thereof and pivotally connected to the transverse through hole of said holder frame by a pivot pin.

5. The gas intake control mechanism as claimed in claim 4, further comprising a third spring member mounted in said elongated base and connected between said elongated base and said striking block and adapted for imparting a biasing force to said striking block relative to said elongated base.

* * * * *